US008795033B2

(12) United States Patent
Fletcher et al.

(10) Patent No.: US 8,795,033 B2
(45) Date of Patent: Aug. 5, 2014

(54) LAPPING CARRIER AND METHOD

(75) Inventors: Timothy D. Fletcher, Lino Lakes, MN (US); Todd J. Christianson, Oakdale, MN (US); Vincent D. Romero, Maplewood, MN (US); Bruce A. Sventek, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 300 days.

(21) Appl. No.: 13/367,424

(22) Filed: Feb. 7, 2012

(65) Prior Publication Data

US 2012/0135669 A1 May 31, 2012

Related U.S. Application Data

(62) Division of application No. 12/513,705, filed as application No. PCT/US2007/085103 on Nov. 19, 2007, now Pat. No. 8,137,157.

(60) Provisional application No. 60/866,768, filed on Nov. 21, 2006.

(51) Int. Cl.

| | |
|---|---|
| ***B24B 1/00*** | (2006.01) |
| ***B24B 37/04*** | (2012.01) |
| ***B24B 37/28*** | (2012.01) |

(52) U.S. Cl.

CPC ..... *B24B 37/28* (2013.01)
USPC ..... 451/59; 451/397

(58) Field of Classification Search

CPC ..... B24B 1/00; B24B 19/14; B24B 37/28; B24B 37/30; B24B 37/32; B24B 37/04; B24B 49/16; B24B 41/06
USPC ..... 451/28, 36, 41, 59, 60, 262, 267, 269, 451/364, 397, 398

See application file for complete search history.

(56) References Cited

U.S. PATENT DOCUMENTS

| | | | |
|---|---|---|---|
| 3,453,783 | A | 7/1969 | Queen |
| 4,739,589 | A | 4/1988 | Brehm et al. |
| 5,085,009 | A | 2/1992 | Kinumura et al. |
| 5,573,448 | A | 11/1996 | Nakazima et al. |
| 5,882,245 | A | 3/1999 | Popovich et al. |
| 5,914,053 | A | 6/1999 | Masumura et al. |
| 6,030,280 | A | 2/2000 | Fruitman |
| 6,042,688 | A | 3/2000 | Masumura et al. |
| 6,077,616 | A | 6/2000 | Serafin et al. |
| 6,080,042 | A | 6/2000 | McGregor et al. |

(Continued)

FOREIGN PATENT DOCUMENTS

| | | |
|---|---|---|
| EP | 0 924 261 | 6/1999 |
| JP | 11-33895 | 2/1999 |

(Continued)

*Primary Examiner* — Dung Van Nguyen

(57) ABSTRACT

Provided is a lapping carrier including a base carrier having a first major surface, a second major surface and at least one aperture for holding a workpiece. The aperture extends from the first major surface through the base carrier to the second major surface. The base carrier includes a first metal or a polymer. At least a portion of the first major surface or at least a portion of each of the first and the second major surfaces includes a polymeric region. In at least a portion of the polymeric region, at least one adhesion promoting layer is interposed between the polymeric region and the base carrier. The adhesion promoting layer includes an inorganic coating.

11 Claims, 1 Drawing Sheet

(56) References Cited

U.S. PATENT DOCUMENTS

| | | | | |
|---|---|---|---|---|
| 6,139,408 | A | 10/2000 | Hakomori | |
| 6,291,373 | B1 * | 9/2001 | Sakaguchi et al. | 442/156 |
| 6,296,554 | B1 | 10/2001 | Lai et al. | |
| 6,419,555 | B1 | 7/2002 | Goers | |
| 6,454,635 | B1 | 9/2002 | Zhang et al. | |
| 6,514,424 | B2 | 2/2003 | Wenski et al. | |
| 6,566,286 | B1 * | 5/2003 | Sakaguchi et al. | 442/281 |
| 6,579,160 | B2 | 6/2003 | Nanjo et al. | |
| 6,709,981 | B2 | 3/2004 | Grabbe et al. | |
| 6,793,837 | B2 | 9/2004 | Wenski et al. | |
| 7,008,308 | B2 | 3/2006 | Bjelopavlic et al. | |
| 7,008,310 | B2 | 3/2006 | Andres | |
| 2002/0115387 | A1 | 8/2002 | Wenski et al. | |
| 2003/0212173 | A1 | 11/2003 | Owens et al. | |
| 2004/0259485 | A1 | 12/2004 | Ensinger | |
| 2004/0261945 | A1 | 12/2004 | Ensinger | |
| 2008/0166952 | A1 * | 7/2008 | Ueno | 451/41 |

FOREIGN PATENT DOCUMENTS

| | | |
|---|---|---|
| JP | 11-254305 | 9/1999 |
| JP | 2002-160156 | 6/2002 |
| JP | 2004-148497 | 5/2004 |

* cited by examiner

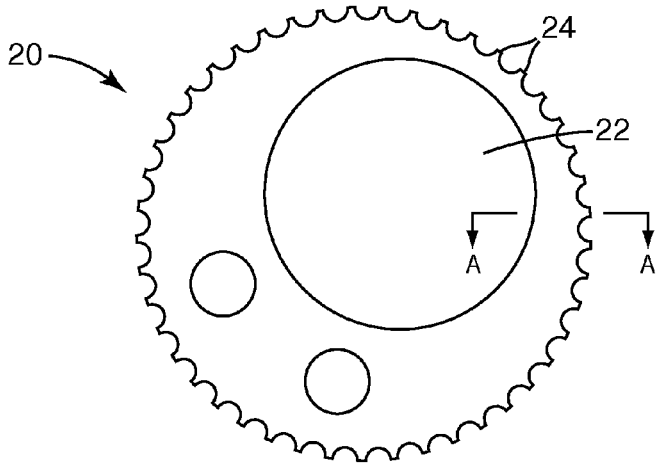
*Fig. 1*
*Fig. 2a*
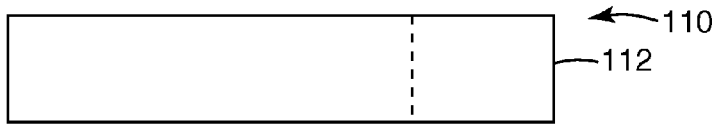
*Fig. 2b*
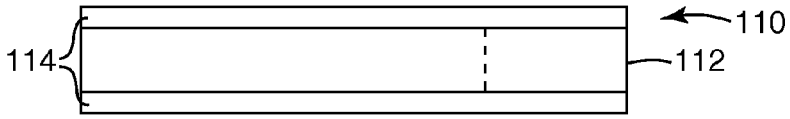
*Fig. 2c*
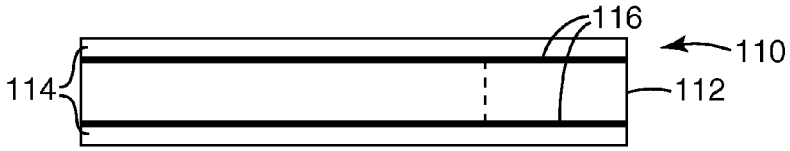
*Fig. 2d*
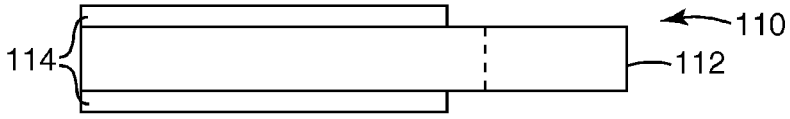
*Fig. 2e*
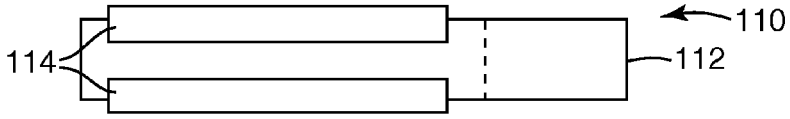

LAPPING CARRIER AND METHOD

CROSS REFERENCE TO RELATED APPLICATIONS

This is a divisional of application Ser. No. 12/513,705, filed May 6, 2009 now U.S. Pat. No. 8,137,157, now allowed; which was a national stage filing under 35 U.S.C. 371 of PCT/US2007/085103 filed Nov. 19, 2007, which claims priority to U.S. Provisional Application No. 60/866,768, filed Nov. 21, 2006, the disclosure of which is herein incorporated by reference herein in their entirety.

TECHNICAL FIELD

This disclosure relates to lapping carriers and methods of lapping including methods using such carriers.

BACKGROUND

A need often arises to grind or polish flat workpieces such as disk-shaped articles, e.g., silicon wafers, sapphire disks, optical elements, glass or aluminum substrates for magnetic recording devices, and the like, such that the two major surfaces are both parallel and free from significant scratches. Such grinding or polishing operations, differing in the rate of material removal and final surface finish, may be referred to collectively as lapping. A typical machine used for finishing the disks includes two superposed platens respectively disposed over and under one or more of the disks, so that opposing surfaces of the disks can be ground or polished simultaneously. Moreover, the lapping machine may include carriers that position and retain the disks during the grinding or polishing operation. Such carriers may be adapted to rotate relative to the platens. For example, the lapping machine may also include an outer ring gear, disposed around an outer periphery of the platens, and an inner gear, that projects through a hole formed in a center of the platens. The carriers can have a toothed outer periphery, which engages with the teeth or pins of the outer ring gear and the teeth or pins of the inner gear. Rotation of the inner gear and outer gear in opposite directions, for example, thus causes the carrier to rotate globally around the inner gear, and about an axis of the carrier.

Typically, the manufacturer of the single- or double-sided finishing machine will polish the surfaces of the platens using a lapping technique, prior to the polishing machine being shipped to the end user. It is conventionally believed that the lapping technique provides the platens with a relatively flat and planar surface suitable for most polishing operations.

To polish the workpieces, a polishing slurry is provided on a surface of the disks. The platens are brought together to exert a predetermined pressure upon the workpieces, and the carriers and workpieces are rotated, thus planarizing, polishing and/or thinning the surfaces of the workpieces.

Recently, fixed abrasive articles disposed over the working surfaces of the platens have been employed to reduce maintenance costs and the accompanying unproductive time associated with periodic dressing of the platens to the necessary degree of flatness and coplanarity.

It has further been observed that during the polishing of glass disks, for example, that the teeth of the carriers tend to wear prematurely. In fact, the teeth can become so worn that they will shear off from the carrier, causing the lapping machine to become inoperative (i.e., a so-called mid-cycle crash). As will be appreciated, since the carriers are relatively expensive, a long life is desirable. Moreover, mid-cycle crashes require that the polishing machine be removed from service for an extended period of time, thus reducing throughput and increasing the cost of operations.

SUMMARY

Several problems have been encountered when using fixed abrasives in dual-sided lapping applications. As the carriers contact the fixed abrasive under the pressure and relative motion associated with the lapping process, asymmetrical polishing can occur. Asymmetrical polishing is when one or more polishing characteristics, such as workpiece removal rate, are not identical between the upper surface and lower surface of the workpiece being polished. When using a fixed abrasive, this effect has been attributed to the dulling of the fixed abrasive by its contact with the carrier. In addition to dulling of the abrasive, a second problem associated with contact between the abrasive and the carrier is excessive wear of the carrier. Carrier wear may make the carriers so thin that they are not usable because of bending or tearing.

Current solutions to the problem of dulling of fixed abrasives by carrier materials and the resulting asymmetrical polishing performance include periodic conditioning of the fixed abrasive and the use of alternative carrier materials. During conditioning of the fixed abrasive, a second abrasive is brought into contact with the fixed abrasive under load and relative motion to wear away the portion of the fixed abrasive that has been affected by the carrier material. This technique relies on consuming the fixed abrasive to compensate for the degradation caused by the carrier—fixed abrasive interaction. Consuming the fixed abrasive by conditioning reduces the number of workpieces that can be ground with the abrasive which may limit the maximum value of the abrasive article. The reduction in process throughput because of the additional process step (conditioning) is also undesirable. In some instances, fixed abrasive still may need conditioning to achieve a desirable pad flatness.

The use of alternative carrier materials has typically involved using polymeric materials such as phenolics or epoxies to replace the stainless steels often used to produce carriers. Since the carrier must be as thin as or thinner than the workpiece to allow simultaneous lapping of both surfaces, there are limits on the overall thickness of the carrier. When the workpieces become thin (up to about 1 mm thickness) and large in diameter (e.g., at least about 150 mm) the carriers made from polymeric materials become too flexible for use, e.g., bending causes a mid-cycle crash or the workpieces to be broken. Fiber reinforcing materials such as glass are sometime used to increase the modulus of the polymeric carrier materials. However, the glass fibers can also cause a dulling of fixed abrasive.

It has been found that coating or laminating protective layers of a polymer, in some embodiments preferably a urethane resin, on the working surfaces of a metal carrier provides the dual benefits of greatly reducing the dulling of the fixed abrasive articles and of extending the life of the carrier. In so far as abrasive dulling may also be a problem in single-sided lapping operations, some embodiments of the invention include carriers in which the coating or layer is present only on the surface of the carrier which contacts the abrasive surface of the lapping machine.

In one embodiment, the invention is a lapping carrier including a base carrier having a first major surface, a second major surface and at least one aperture for holding a workpiece. The aperture extends from the first major surface through the base carrier to the second major surface. The base carrier includes a first metal or a polymer. At least a portion of the first major surface or at least a portion of each of the first and the second major surfaces includes a polymeric region. In at least a portion of the polymeric region, at least one adhesion promoting layer is interposed between the polymeric region and the base carrier. The adhesion promoting layer includes an inorganic coating.

In another embodiment, the invention is a method of lapping. The method includes providing a double-sided lapping machine having two opposed lapping surfaces or a single-sided lapping machine; providing a carrier comprising a base carrier having a first major surface, a second major surface and at least one aperture for holding a workpiece, the aperture extending from the first major surface through the base carrier to the second major surface; providing a workpiece; inserting the workpiece into the aperture; inserting the carrier into the lapping machine; providing relative motion between the workpiece and the lapping surface while maintaining contact between the lapping surface and the workpiece; and removing at least a portion of the workpiece. The base carrier includes a first metal or a polymer. At least a portion of the first major surface or at least a portion of each of the first and the second major surfaces includes a polymeric region. In at least a portion of the polymeric region, at least one adhesion promoting layer is interposed between the polymeric region and the base carrier, the adhesion promoting layer including an inorganic coating.

Other features and advantages of the invention will be apparent from the following detailed description of the invention and the claims. The above summary of principles of the disclosure is not intended to describe each illustrated embodiment or every implementation of the present disclosure. The figures and the detailed description that follow more particularly exemplify certain preferred embodiments using the principles disclosed herein.

BRIEF DESCRIPTION OF THE DRAWINGS

FIG. 1 is a workpiece carrier of one embodiment of the invention.

FIGS. 2*a*-2*e* are partial sections of workpiece carriers useful in double-sided lapping according to various embodiments of the invention.

DETAILED DESCRIPTION

The recitation of numerical ranges includes all numbers within that range (e.g., 1 to 5 includes 1, 1.5, 2, 2.75, 3, 3.80, 4, and 5). All numbers are herein assumed to be modified by the term "about."

Flat, single-sided lapping of substrates is a process that has been used for years in electronics and other industries. It is used to grind and/or polish one of the major surfaces of a variety of workpieces, for example, glass or metal disks used as substrates for magnetic recording coatings, semiconductor wafers, ceramic, sapphire, optical elements, and the like. It is generally desirable to achieve high degrees of both flatness and uniformity of thickness in addition to the preferred surface finish. Such single-sided lapping machines may use a variety of abrasive features or surfaces depending upon the characteristics desired. In general, the workpiece is held in a fixture that is brought into contact with a platen under a specified load. The workpiece/fixture combination and the platen are then set into relative motion to achieve the desired amount of material removal. The workpiece/fixture combination may be rotating (due to friction or driven by a motor) or stationary. The platen may be rotation or stationary depending on the motion of the workpiece/fixture combination. The workpiece/fixutre combination can also be moved laterally with respect to the rotating platen in order to facilitate both uniform removal of the workpiece and uniform wear of the platen. The platen may be fabricated from or covered with a material suitable for slurry-based polishing. Alternatively, they may be fitted with buttons containing abrasive particles, often diamonds or other superabrasives, embedded in a rigid matrix. More recently a textured three-dimensional fixed abrasive article, such as Trizact™ Diamond Tile has been applied to the surface of the platen to provide the abrasive action.

Flat, double-sided lapping of substrates is becoming increasingly common in electronics and other industries. It is used to simultaneously grind and/or polish both major surfaces of a variety of workpieces, for example, glass or metal disks used as substrates for magnetic recording coatings, semiconductor wafers, ceramic, sapphire, optical elements, and the like. It is generally desirable to achieve high degrees of both flatness and uniformity of thickness in addition to the preferred surface finish. Such double-sided lapping machines may use a variety of abrasive features or surfaces depending upon the characteristics desired. The upper and lower platens may be fabricated from or covered with a material suitable for slurry-based polishing. Alternatively, they may be fitted with buttons containing abrasive particles, often diamonds or other superabrasives, embedded in a rigid matrix. More recently a textured three-dimensional fixed abrasive article, such as Trizact™ Diamond Tile has been applied to the surface of the platens to provide the abrasive action.

FIG. 1 illustrates a typical workpiece carrier for flat, dual side polishing or grinding. The workpiece is inserted into an aperture 22 in a carrier 20 which bears teeth 24 around the perimeter. The circumference of aperture 22 is defined by the surface area of the single support associated with the support thickness. In some instances, the circumference of the aperture in the support is fabricated to be larger and may be of a different shape than the required circumference and shape to hold a workpiece. An insert, having a second aperture of the desired circumference and shape to facilitate holding of the workpiece, may then be mounted in the support aperture. Any known insert can be used, e.g., those described in U.S. Pat. No. 6,419,555. The insert typically comprises a different material from that of the support. The carrier teeth engage corresponding teeth or pins (not shown) disposed around an outer periphery of the platens, and an inner gear, sometimes referred to as a sun gear, that projects through a hole formed in a center of the platens. The carriers can then have a toothed outer periphery, which engages with the teeth or pins of the outer ring gear and the teeth or pins of the inner gear. Rotation of the inner gear and outer gear in opposite directions, for example, thus causes the carrier to rotate globally around the inner gear, and about an axis of the carrier. Carriers also can be designed to rotate about a platen using a sun gear and a ring gear, which may move in the same direction but at different speeds.

FIG. 2*a* is illustrative of a cross-section corresponding to section A-A of FIG. 1 of a carrier 110 of the prior art which consists of a single support, i.e., base carrier 112, typically metal for rigidity. FIG. 2*b* is illustrative of one embodiment of the invention in which the carrier 110 comprises base carrier 112 bearing polymeric layers 114 on the opposed major faces, i.e., major surfaces, of the carrier. The embodiment of FIG. 2*c* includes optional adhesion promoting layers 116 interposed between the base carrier 112 and the polymeric layers 114. The adhesion promoting layers 116 may comprise multiple layers of chemically distinct materials. In the embodiment of FIG. 2*d*, the coatings of polymeric layer 114 do not cover the entire surface of the support (base carrier) 112. FIG. 2*e* is an embodiment which maintains a greater thickness of the support (base carrier) 112 in regions requiring greater mechanical stiffness, for example the region of the teeth and the region of contact with the workpiece.

Although the embodiments of FIGS. 2*b*-2*e* indicate that substantially all of both major surfaces of the carrier, with the possible exception of the toothed region, are covered by the polymeric layers, it should be appreciated that the polymeric layers may be discontinuous in other embodiments and may be present in multiple regions on either or both major surfaces of the carrier. Continuous or discontinuous polymeric layers covering at least a portion of the major surfaces of the carrier may be desirable to optimize (e.g., reduce) the overall friction between the workpiece and carrier and the abrasive surfaces of the lapping platens and/or to provide enhanced flow of a working fluid for cooling, lubrication, chemical modification of the surfaces being abraded, swarf removal, and the like. In some embodiments, the polymeric layers or regions may be textured to reduce contact drag or to improve working fluid flow. In some embodiments, the polymeric region or regions on one major surface of the carrier may be connected to the polymeric region or regions on the opposite major surface. In some embodiments a third surface, corresponding to the surface area of the base carrier defining the aperture circumference, may be at least partially coated by the polymer comprising the polymeric layers.

Selection of the polymeric layers to enhance the performance of workpiece carriers used in double-sided lapping requires balancing several properties. The coated carrier must remain sufficiently rigid to drive the workpiece or workpieces between the abrasive platens while remaining thin enough to be used to lap the very thin workpieces desired in the electronics and related industries. Generally, it is desirable for the thickness of the carrier to be less than the desired final thickness of the workpiece. The polymeric layer should not cause undue dulling of the abrasive or undue wear of the abrasive surfaces which it contacts and it should be resistant to chemicals present in the working fluid. In some embodiments, it is also desirable to avoid interactions with the abrasive which may lead to dulling. In still other embodiments, polymeric layers with substantial wear resistance are desirable.

It has been found that materials which exhibit a large work to failure (also known as Energy to Break Stress), as demonstrated by a large integrated area under the stress versus strain curve, are particularly well suited as wear resistant materials in this application. It has been determined that polymers having a work to failure of at least about 5 Joules, at least about 10 Joules, at least about 15 Joules, 20 Joules, 25 Joules, 30 Joules, or even higher can be used as wear resistant polymeric layer for carriers. The polymers comprising the polymeric layers may be a thermoset, a thermoplastic or combinations thereof. The thermoplastic polymers may include a class of polymers commonly referred to as thermoplastic elastomers. The polymers may be applied as a coating or as a laminated film. After applying the coating or film, further drying, annealing and/or curing of the coating or film may be required in order for the polymeric layer to reach its optimal utility. In some embodiments, the polymeric layers may comprise multiple layers of chemically distinct polymers.

In addition to possessing appropriate mechanical properties, the polymeric layers must be able to withstand the chemical environment of the lapping operation without undue degradation of its properties. Polymers such as polyurethanes, epoxies, and certain polyesters typically have the desired chemical resistance to the working fluids employed and may be used as the polymeric layers. Preferred polymers comprising the polymeric layers or regions include thermoset polyurethanes, thermoplastic polyurethanes and combinations thereof. Polyurethanes formed from the reaction of hydroxyl terminated polyether or hydroxyl terminated polyester prepolymers with diisocyanates may be employed. Crosslinking of the polyurethane may be desirable. Crosslinking of the polyurethane may be achieved by conventional crosslinking reactions. One preferred crosslinking system is the reaction of a diisocyanate terminated polyurethane, such as Adiprene™ L83 available from Chemtura Corp. (Middlebury, Conn.), with an aliphatic or aromatic diamine, such as Ethacure™ 300 also available from Chemtura Corp. Thermoplastic polyurethane films, such as Estane™ 58219 available from Lubrizol Corp. (Wickliffe, Ohio) also may be used as the polymer layer of the present invention.

In some embodiments, an adhesion promoting layer (APL) may be interposed between the base carrier and the polymeric layers to improve the integrity of the coated carrier. The APL improves the adhesion between the base carrier and the polymeric layers. The APL may comprise multiple layers of similar chemical composition or, preferably, multiple layers having distinct chemical compositions. The adhesion promoting layer may be located on one or more of the base carrier's surfaces. Preferably, the APL is located on the two major opposed surfaces of the base carrier.

The adhesion promoting layer may be formed by chemical modification of one or more of the base carrier's surfaces or by providing a coating which functions as an APL on one or more of the base carrier's surfaces. Chemical modification of the base carrier's surface may be accomplished by conventional techniques, e.g., plasma, e-beam or ion beam processing. A preferred process is plasma processing in the presence of one or more gases. Useful gases include tetramethyl silane (TMS), oxygen, nitrogen, hydrogen, butane, argon and the like. Plasma surface treatment results in the formation of various functional groups on the surface of the base carrier. Preferred functional groups include atom pairs that comprise oxygen bonded to carbon, oxygen bonded to silicon, nitrogen bonded to carbon and hydrogen bonded to nitrogen. Plasma processing can also be used to clean the surface of the base carrier prior to applying the APL. A preferred gas for this purpose is argon.

The APL may be an inorganic coating or an organic coating. Useful inorganic coatings include metals and metal oxides. Preferred inorganic coatings include coatings containing atom pairs that comprise oxygen bonded to silicon, chromium bonded to nickel, oxygen bonded to zirconium or oxygen bonded to aluminum. Preferred metal oxide coatings include silica, zirconia, alumina and combinations thereof. Additionally, metal coatings may be employed as an APL, aluminum and aluminum titanium nitride being two preferred coatings. The inorganic coatings can be applied by conventional techniques. Preferred techniques include sol-gel, electrochemical deposition, and physical vapor deposition. More preferably, physical vapor deposition techniques such as sputtering, ion plating, and cathodic arc type techniques are useful in precisely controlling the thickness and uniformity of the coatings for metals, alloys, nitrides, oxides, and carbides. These vacuum deposition techniques allow for a solvent-free, dry and clean process.

Useful organic coatings can vary widely in chemical composition and form. Generally, an organic APL has chemical characteristics, e.g., one or more functional groups that enhance the adhesion between the base carrier and the polymeric layers. The organic coatings, in final form, are typically polymeric, although low molecular weight compounds may also be useful in enhancing adhesion. Low molecular weight materials commonly referred to as coupling agents fit this classification, including silane coupling agents, e.g., amino silane, epoxy silanes, vinyl silanes, isocyanto silanes, uredio silanes and the like. A preferred amino silane is Silquest™ A-1100 available from Momentive Performance Materials (Wilton, Conn.).

A polymeric APL may be a thermoset or thermoplastic, including a thermoplastic polymer film. The polymeric APL may initially comprise monomers or oligomers that are polymerized and/or crosslinked after coating onto the appropriate surface. When applied to a substrate, the polymeric APL may be substantially one hundred percent in solids content or it may contain solvent that is substantially removed after coating. The polymeric APL may also be a polymer solution in which the solvent is substantially removed after coating. The polymeric APL may be polymerized and/or crosslinked after coating via standard techniques, including thermal curing and radiation curing. Commercially available materials commonly called primers or adhesives may be used as an APL. Preferred materials include Chemlok™ 213 (a mixed polymer adhesive, for urethane elastomers, with curatives and dye dissolved in an organic solvent system) and Chemlok™ 219 (an elastomeric primer/adhesive), both available from Lord Corp. (Cary, N.C.), C-515-71 HR available from Chartwell International, Inc. (North Attleboro, Mass.) and Epon™ 828 epoxy available from Miller-Stephenson Chemical Company, Inc. (Danbury, Conn.). The organic coating can be applied to the base carrier and/or polymeric layer by conventional techniques including spray coating, dip coating, spin coating, roll coating, or coating with a brush or roller.

Several adhesion promoting layers may be applied in sequence creating an adhesion promoting layer which comprises multiple layers. When a multi-layer APL is employed, the separate APLs may include any number of the various types of APLs; a chemically modified surface, an inorganic coating, an organic coating and combinations thereof. The APLs may be combined in any desired layering sequence that facilitates the desired level of adhesion. Selection of the APL depends on a variety of factors including the composition of the base carrier and the composition of the polymeric layers. The order in which the various layers; base carrier, APL(s) and polymeric layer(s); of the lapping carrier are attached to one another may be selected based on achieving optimal utility of the lapping carrier and process considerations associated with applying the various layers. In some embodiments, the APL is first adhered to the base carrier followed by adhesion to the polymeric layer. In other embodiments, the APL is first adhered to the polymeric layer followed by adhesion to the base carrier. In still other embodiments having a multi-layer APL, the APLs may be sequenced one above the other starting with the base carrier as the initial substrate or the APLs may be sequenced one above the other starting with the polymeric layer as the initial substrate. In some embodiments, one or more APLs may be applied in sequence to the base carrier and one or more APLs may be applied in sequence to the polymeric layer followed by joining of the outer most APL of the base carrier and polymeric layer. In some embodiments, a preferred multi-layer APL comprises a first adhesion promoting layer comprising a dried and cured Chemlok 219 compound adjacent to a second adhesion promoting layer comprising a dried and cured Chemlok 213 compound.

It is known that different lapping applications may require different levels of adhesion between the base carrier and the polymeric layer. A lapping process employing corrosive polishing solutions, high temperatures or having high degrees of shear transferred to the carrier may require higher adhesion between the base carrier and polymeric layers compared to a process employing less severe conditions. The selection of the adhesion promoting layers subsequently may depend on the lapping process conditions and or workpieces being abraded.

Prior to conducting chemical modification or applying an APL to the base carrier surface or polymeric layer surface, it is often desirable to clean the surface. Conventional cleaning techniques may be employed, such as, washing the surface with a soap solution followed by rinsing with water or washing the surface with an appropriate solvent, e.g. methylethylketone, isopropanol or acetone, followed by drying. Depending on the composition of the carrier or polymeric layer, cleaning with an acid or base solution may also be useful. Sonication may also be used in conjunction with the above cleaning techniques. Additionally, plasma cleaning/surface contamination removal with argon as the gas is a preferred cleaning technique, particularly when the base carrier being coated is a metal, e.g., stainless steel.

In some embodiments, the base carrier comprises metal, glass, polymer, or ceramic. Preferred metals include steel and stainless steel. Preferred polymers include thermoset polymers, thermoplastic polymers and combinations thereof. The polymer may contain one or more fillers or additives, chosen for a specific purpose. Inorganic fillers may be employed to lower the cost of the carrier. Additionally, reinforcing fillers such as particles or fibers may be added to the polymer. Preferred reinforcing fillers are inorganic in nature and may comprise surface modification to improve the reinforcing effect. Nanoparticles, e.g. nanosilica, may also be of utility. The polymer may also contain layers or regions of reinforcing matting, typically woven materials, e.g. polymeric fiber matting, fiber glass matting or a metal screen.

In some embodiments, the base carrier and the polymeric region comprise different materials. In some embodiments, the polymeric regions comprise a polymeric coating or a laminated polymeric film. In some embodiments, each major surface of the carrier comprises two or more polymeric regions. In some embodiments, the regions comprise a urethane polymer, which can be a crosslinked polymer. In some embodiments, the polymer of the polymeric region has a work to failure of at least about 5, 15, 20, 25, Joules, or even higher.

In some embodiments, the disclosed method includes providing a working fluid at the interface between the workpiece and the lapping surfaces. In some embodiments, the method of the invention includes providing a working fluid comprising abrasive particles. In some embodiments, the method of the invention includes the use of a double-sided lapping machine wherein at least one of the two opposed lapping surfaces comprises a three-dimensional, textured, fixed-abrasive article. In some embodiments, the method of the invention employs three-dimensional, textured, fixed-abrasive articles comprising diamond particles disposed in a binder as at least one of the two opposed surfaces of the lapping machine. In some embodiments, the method of the invention employs three-dimensional, textured, fixed-abrasive articles comprising diamond agglomerates disposed in a binder as at least one of the two opposed surfaces of the lapping machine. In some embodiments, the method of the invention employs three-dimensional, textured, fixed-abrasive articles comprising diamond agglomerates disposed in a binder wherein the diamond agglomerates comprise a binder different from the binder of the three-dimensional, textured, fixed-abrasive article.

In yet other embodiments, the disclosed method employs pellet laps on at least one of the two opposed lapping surfaces of the lapping machine. In some embodiments, the double-sided lapping machine is replaced by a single-sided lapping machine and the base carrier includes at least one polymeric region on the surface of the carrier which contacts the abrasive surface of the lapping machine.

Various modifications and alterations of this invention will become apparent to those skilled in the art without departing from the scope and spirit of this invention, and it should be understood that the invention is not to be unduly limited to the illustrative embodiments set forth herein as follows.

EXAMPLES

Where not otherwise specified, materials were available from chemical supply houses, such as Aldrich, Milwaukee, Wis.

| Materials | |
|---|---|
| C219 | Chemlock ™ 219, a mixed polymer adhesive for bonding castable urethane elastomers to metals, available from Lord Corporation (Cary, NC) ("Lord"). |
| C213 | Chemlock ™ 213, a mixed polymer primer/adhesive to bond castable urethane elastomers to metals, available from Lord. |
| T248 | Thinner 248, a solvent mixture, available from Lord. |
| Epoxy | Epon 828, a bisphenol A diglycidyl ether available from the Miller-Stephenson Chemical Company, Inc. (Danbury, CT). |
| V125 | Versamid ™ 125, a reactive polyamide resin, available from Congis Corp. (Cincinnati, OH). |
| L-7604 | Silwet ™ L-7604, a wetting agent, available from Momentive Performance Materials (Wilton, CT). |
| Dow 7 | Dow 7, a wetting agent, available from Dow Chemical Corp. (Midland, MI). |
| A-1100 | Silquest ™ A-1100, an amino functional silane, available from Momentive Performance Materials. |
| L83 | Adiprene ™ L83, a TDI - terminated polyether based prepolymer available from Chemtura Corp. (Middlebury, CT). |
| E300 | Ethacure ™ 300, a liquid aromatic diamine which is a mixture of the 2,4- and 2,6-isomers of dimethylthiotoluenediamine available from Chemtura Corp. |
| C-515.71HR | C-515-71HR, an adhesion promoter, available from Chartwell, International, Inc. (North Attleboro, MA). |
| M5 | Cab-O-Sil ™ M5 available from Cabot Corp (Tuscula, IL). |
| C213A | A solution of 49.95% C213, 49.95% methylethylketone, and 0.1% Dow 7 (all percentages based on weight). |
| C213B | A solution of 50% C213 and 50% Thinner 248 (all percentages based on weight). |
| C219A | A solution of 49.95% C219, 49.95% isopropanol, and 0.1% Dow 7 (all percentages based on weight). |
| Urethane1 | A two part urethane coating consisting of 10 g methylethylketone, 36.0 g L83 and 3.6 g of a premix of 82.00% E300, 16.30% titanium dioxide, 0.43% M5 and 1.27% Dow 7 (all % based on weight). |
| E58219 | A 75 μm thick thermoplastic urethane film, Estane ™ 58219, commercially available from Lubrizol Corp. (Wickliffe, OH). |
| PE1 | A 1.4 mil (35.6 μm) thick polyethylene terephthalate film. |
| ETMS | 3,4-epoxycyclohexylethyltrimethoxysilane available as Silquest ® A-186 from GE Silicones (Friendly, WV). |
| ATES | 3-aminopropyltriethoxysilane, product number SIA0610.0 available from Gelest, Inc. (Morrisville, PA). |

Test Methods

Test Method 1, Adhesion

A test method was developed to examine the adhesion of urethane coatings to the surface of stainless steel coupons. Two coupons of each example were soaked in deionized water at 53° C. for 2 hours. After soaking, any coating that was not delaminated or that could not be easily peeled away from the stainless steel was considered to have passed the test. One coupon of the two was required to meet these criteria for an example to pass.

Test Method 2, Polishing

Carriers were tested using a Peter-Wolters AC500 (Peter-Wolters of America, Des Plaines, Ill.) double-sided lapping machine to polish 800 μm thick, 100 mm diameter silicon wafers. A polishing cycle involved the simultaneous polishing of three wafers each inserted within its own carrier for a 10 min. polishing time. The carrier rotation was alternated from clockwise (CW) to counterclockwise (CCW) with each polishing cycle, starting with clockwise rotation. The machine was operated at a platen speed of 96 rotations per minute (rpm) and a pressure of 9.65 kPa (1.4 psi) with the sun gear (inner ring) at 14 rpm. Deionized water was supplied at 500 mL/min. to provide cooling and swarf removal. The fixed abrasive pads were 4A—DT 6-015 Trizact™ Diamond Tile (3M Company, St. Paul, Minn.) which were conditioned, before and between successive tests, by running annular 600 grit aluminum oxide stones, one minute CW and one minute CCW to establish comparable initial states of the pad surfaces for each test. Removal rates of the wafers were determined gravimetrically. Unless otherwise noted, data is the average of the three wafers per cycle. Uniformity of the removal rate relative to the top wafer surface and bottom wafer surface was monitored by visually observation. Visual asymmetry of the wafer edge profile after polishing indicated asymmetry in the polishing rate, i.e., the removal rate differed between the top and bottom surfaces of the wafer.

Test Method 3, Tensile

A tensile test method was used to determine mechanical properties of films. The test generally followed ASTM D638 except that a sample gauge length of 25 mm and a sample width of 25 mm were used with a crosshead speed of 101.6 cm/min. (40 inches/min.).

Test Method 4, Wear

Test method 4 subjects the polymeric layer coated carriers to an accelerated wear test using both a deionized water soak and a single-sided lapping process. The deionized water soak involved soaking the carriers in deionized water at 63° C. for two hours. The lapping process is conducted on a Peter-Wolters AC500 tool. A fixed abrasive pad, 4A—DT 6-015 Trizact™ Diamond Tile, was mounted on the lower platen. Each carrier was mounted on the platen, with the teeth of the carrier engaging the inner and outer ring pins. A 100 mm diameter silicon wafer was mounted in the carrier. Two 3.3 kg gears of the same outer geometry as the carriers being tested having an inside diameter of 124.8 mm were placed on top of the test carrier. Four 1.13-kg plates were placed on the center of the carrier, inside the ring gears. Two 4.5 kg plates were then placed on top of the ring gears. The 4.5 kg plates did not contact the four, 1.13-kg plates in the center of the carrier. The total weight on the center of the carrier was about 4.5 kg with the total weight on the carrier being about 20 kg. The contact area of the carrier was about 165 $cm^2$, yielding an average pressure on the carrier of about 0.12 $kg/cm^2$. The AC500's lower platen was rotated at 96 rpm and its sun gear was rotated at 14 rpm. The working fluid used in the test was a recycled, aqueous solution containing silicon swarf from a previous grinding process. The previous grinding process was a double sided lapping process using a 6 μm diamond abrasive, a 4A—DT 6-015 Trizact™ Diamond Tile pad (3M Company) to grind silicon wafers. The recycled, aqueous solution contained less than about 0.5% silicon by weight. The test time for Test Method 4 was 10 minutes, after which, the platen and gear rotation was stopped, the weights removed from the carriers and the carriers removed from the tool. The carriers were examined visually for delamination of the polymeric layer.

Examples 1 to 32

Number 304 stainless steel coupons, 0.5 inch (1.27 cm) in width by 6 inch (15.2 cm) in length, were used. The stainless steel coupons represent one type of material from which a base carrier could be fabricated. The surface of the coupons was cleaned with isopropanol or methylethylketone (MEK). The surface was then roughened by abrading with Scotch-Brite® Deburring wheel, SST grade 7A FINE having a 6 inch outside diameter by 1 inch width with a 1 inch center hole (3M Company). The surface of the stainless steel coupons was cleaned again by twice wiping with isopropanol, dried and then exposed to an argon plasma. The plasma process was as follows: The coupons were placed on the powered electrode in a vacuum chamber. The chamber was pumped down to less than 1 mTorr (0.13 Pa). Argon was introduced at 20 mTorr (2.7 Pa) and then used to plasma clean at 2000 watts. After 1 minute the power and gases were turned off. Coupons that were to be subsequently modified with a plasma formed APL were left in the chamber under vacuum and immediately treated with the plasma to form the APL, as documented in Table 1. If no further plasma treatment was desired, the chamber was evacuated and the vacuum was released.

A series of various Adhesion Promoting Layers or APL's were applied to the stainless steel coupons as shown in Table I. The APL's were applied in the sequence listed in Table I. Note that any treatment of the stainless steel surface, including chemical modification via a plasma surface treatment, is considered to form an APL. It should be noted that the plasma treatments were conducted in a different vacuum chamber from that of the sputter coating processes. After the indicated APL was applied to the coupon, a polymeric layer comprising a urethane coating was applied to each stainless steel coupon. Two coupons were prepared for each sample. The composition and process for applying each APL and the polymeric layer are discussed below.

Adhesion Promoting Layers (APL's)

Plasma 1 was a two step process, as follows. Step 1: Tetramethylsilane, at 150 sccm (standard cubic centimeter per minute), was introduced with Argon, at 20 mTorr (2.7 pa), as the carrier gas. Power, 2000 watts, was applied for 10 seconds at 25 mTorr (3.3 Pa). Power and gas flow was turned off and the chamber remained under vacuum. Step 2: Tetramethylsilane, at 150 sccm, and Oxygen, at 500 sccm, were then introduced with Argon, at 20 mTorr (2.7 Pa), as the carrier gas. Power, 2000 watts, was applied for 20 seconds at 60 mTorr (8.0 Pa). Power and gas flow was turned off; chamber remained under vacuum. After the coupon was treated, the chamber was evacuated and vacuum was released. The sample was then removed.

Plasma 2 was a three step process, as follows. Step 1: Same as Step 1 from Plasma 1. Step 2: Same as Step 2 from Plasma 1 except without argon carrier gas. Also, the power, 2000 watts, was applied for 10 seconds at 50 mTorr (6.7 Pa). Step 3: Oxygen, at 500 sccm, was introduced. Power, 2000 watts, was applied for 30 seconds at 47 mTorr (6.3 Pa). Power and gas flow was turned off and the chamber remained under vacuum. After the coupon was treated, the chamber was evacuated and vacuum was released. The sample was then removed.

Plasma 3 was a four step process as follows. Step 1: Same as Step 1 from Plasma 1. Step 2: Tetramethylsilane, at 150 sccm, and butane, at 200 sccm, were introduced with Argon, at 20 mTorr (2.7 Pa), as the carrier gas. Power, 2000 watts, was applied for 8 seconds at 40 mTorr. Step 3: Butane, at 200 sccm, was introduced with Argon, at 20 mTorr (2.7 Pa), as the carrier gas. Power, 2,000 watts, was applied for 20 seconds at 30 mTorr (4.0 Pa). Power and gas flow was turned off and the chamber remained under vacuum. Step 4: Oxygen, at 500 sccm, was introduced. Power, 2000 watts, was applied for 10 seconds at 50 mTorr (6.7 Pa). Power and gas flow was turned off and the chamber remained under vacuum. After the coupon was treated, the chamber was evacuated and vacuum was released. The sample was then removed.

Plasma 4 was a three step process as follows. Step 1: Same as Step 1 from Plasma 1 except power was applied for 20 seconds. Step 2: Tetramethylsilane, at 150 sccm, was introduced with Argon, at 20 mTorr (2.7 Pa), and Nitrogen, at 40 mTorr (5.3 Pa), as the carrier gases. Power, 2000 watts, was applied for 20 seconds at 63 mTorr (8.4 Pa). Power and gas flow was turned off and the chamber remained under vacuum. Step 3: Nitrogen, at 40 mTorr (5.3 Pa), was introduced. Power, 2000 watts, was applied for 60 seconds at 40 mTorr (5.3 Pa). Power and gas flow was turned off; chamber remained under vacuum. After the coupon was treated, the chamber was evacuated and vacuum was released. The sample was then removed.

Plasma 5 was a two step process as follows. Step 1: Same as Step 1 from Plasma 1. Step 2: Tetramethylsilane, at 150 sccm, was introduced with Nitrogen, at 40 mTorr (5.3 Pa), as the carrier gas. Power, 2000 watts, was applied for 60 sec at 60 mTorr (8.0 Pa). Power and gas flow was turned off and the chamber remained under vacuum. After the coupon was treated, the chamber was evacuated and vacuum was released. The sample was then removed.

NiCr APL's were formed by a sputter deposition process. The cleaned coupon was placed in another vacuum chamber and pumped down to less than 1 mTorr (0.13 Pa). Argon, at 400 sccm and 8 mTorr (1.1 Pa), was introduced. Power of 1500 watts was applied to the nickel chrome sputtering target for a residence time of 2.5 minutes. Power and gas flow was turned off and the chamber remained under vacuum. After the coupons were treated, the chamber was evacuated and vacuum was released. The sample was then removed.

Black Alumina, i.e., oxidized aluminum, APLs were sputter deposited by reactive sputter deposition from an aluminum metal target. After cleaning, the stainless steel coupons were placed on a substrate holder set-up inside a vacuum chamber with a sputtering aluminum target 16 inches (40.6 cm) above the substrate holder. After the chamber was evacuated to $1\times10^{-5}$ Ton ($1.33\times10^{-3}$ Pa) base pressure, sputter gas (Argon) was admitted inside the chamber at a flow rate of 100 sccm). Reactive gas oxygen was added to the chamber at a flow rate of 3 sccm. The total pressure of the chamber was adjusted to 2 mTorr (0.27 Pa) by adjusting the gate valve. Sputtering was initiated using a DC power supply at a constant power level of 2 kW. The sputter duration was 1 hour. The substrate was not heated and kept at room temperature. After the coupon was treated, the chamber was evacuated and vacuum was released. The sample was then removed.

Aluminum APL's were formed using a sputter deposition process similar to that employed for the deposition of oxidized aluminum coatings except no reactive gas oxygen was admitted into the chamber and the sputter duration was 30 minutes.

Zirconium oxide APL's were formed using a sputter deposition process similar to that employed for the deposition of oxidized aluminum coatings. Process modifications included a zirconium target replacing the aluminum target with the sputter power being 1 kW for a duration of 30 min.

Silicon Oxide APL's were formed by the following process. The coupons were cleaned as previously described except, after the final isopropanol wipe, the coupons were dried for 30 minutes at 120° C. The argon plasma clean was replaced by oxygen plasma with a power of 100 watts. Silicon oxide, 60 nm, was deposited on the surface of the coupon by plasma enhanced chemical vapor deposition at 350° C. using $SiH_4$ and $N_2O$ gases at a power of 110 watts.

Coating 1 was a 60/40 by weight mixture of C219 and MEK. Coating 1 was spray coated onto the coupon surface, such that after drying/curing, a coating thickness ranging from about 10 to 15 μm was obtained. One major surface of the coupon was coated first, allowed to air dry, followed by spraying of the other major surface and air drying. The coupon was then cured in an oven at 90° C. for 30 minutes.

Coating 2 was a 60/40 by weight mixture of C213 and T248. Coating 2 was spray coated onto the coupon surface, such that after drying, a coating thickness ranging from about 20 to 25 μm was obtained. One major surface of the coupon was coated first, allowed to air dry, followed by spraying of the other major surface and air drying.

Coating 3 was a mixture of two solutions. The first solution was prepared by mixing a 60/40 by weight solution of Epoxy/MEK. The second solution was prepared by mixing V125/L-7604/Dow 7/MEK at a weight ratio of 58.98/0.85/0.17/40.00. Coating 3 was then prepared by thoroughly mixing 400.00 g of the first solution with 217.32 g of the second solution. Coating 3 was spray coated onto the coupon surface, such that, after drying/curing, a coating thickness ranging from about 20 to 25 μm was obtained. One major surface of the coupon was coated, air dried, cured in an oven at 90° C. for 30 minutes and then allowed to cool to room temperature. The coating/curing process was repeated for the second major surface. During curing, the coupon was set on a silicone release liner to prevent sticking to the oven surface.

Coating 4 was prepared by mixing A-1100/deionzed water/isopropanol at a weight ratio of 1.0/24.0/75.0. Coating 4 was spray coated onto the coupon surface, such that, after drying/curing, a coating thickness ranging from about 10 to 15 μm was obtained. One major surface of the coupon was coated first, allowed to air dry, followed by spraying of the other major surface and air drying. The coupon was then cured in an oven at 90° C. for 30 min. During curing, the coupon was set on a silicone release liner to prevent sticking to the oven surface.

Coating 5 was a mixture of two solutions. The first solution was prepared by mixing a 60/40 by weight solution of L83/MEK. The second solution was prepared by mixing E300/L-7604/Dow 7/C-515.71HR/MEK at a weight ratio of 49.45/3.30/0.65/6.60/40.00. Coating 5 was then prepared by thoroughly mixing 600.00 g of the first solution with 59.25 g of the second solution. Coating 5 was spray coated onto the coupon surface, such that after drying/curing, a coating thickness ranging from about 10 to 15 μm was obtained. One major surface of the coupon was coated, air dried, cured in an oven set at 90° C. for 30 min. and then allowed to cool to room temperature. The coating/curing process was repeated for the second major surface. During curing, the coupon was placed on a silicone release liner to prevent sticking to the oven surface.

Coating 6 was a 2% (by weight) solution of ATES in water. The coating was applied by dipping the carrier in the solution and blowing off the excess solution with an air gun. The carrier was then placed in an oven at 120° C. for 15 minutes.

Coating 7 was a 2% (by weight) solution of ETMS in water. The coating was applied by dipping the carrier in the solution and blowing off the excess solution with an air gun. The carrier was then placed in an oven at 120° C. for 15 minutes.

Polymeric Layer

The polymeric layer was a mixture of two solutions. The first solution was prepared by mixing a 60/40 by weight solution of L83/MEK. The second solution was prepared by mixing E300/L-7604/Dow 7/MEK at a weight ratio of 55.50/3.75/0.75/40.00. The polymeric layer solution was then prepared by thoroughly mixing 600.00 g of the first solution with 52.8 g of the second solution. The polymeric layer solution was spray coated onto the coupon surface, such that, after drying/curing, a polymeric layer having a thickness ranging from about 60 to 70 μm was obtained. One major surface of the coupon was coated, air dried, cured in an oven at 90° C. for 30 min. and then allowed to cool to room temperature. The coating/curing process was repeated for the second major surface except the curing time was increased to 16 h. During curing, the coupon was set on a silicone release liner to prevent sticking to the oven surface.

TABLE I

| Example | APL1 | APL2 | APL3 | Test Result |
|---|---|---|---|---|
| 1 | — | Coating 1 | Coating 2 | Passed |
| 2 | Plasma 1 | — | — | Passed |
| 3 | Plasma 1 | Coating 1 | Coating 2 | Passed |
| 4 | Plasma 2 | Coating 1 | Coating 2 | Passed |
| 5 | Plasma 2 | Coating 3 | — | Passed |
| 6 | Plasma 3 | Coating 3 | — | Passed |
| 7 | Plasma 3 | Coating 4 | Coating 3 | Passed |
| 8 | Plasma 3 | — | — | Passed |
| 9 | Plasma 4 | — | — | Passed |
| 10 | Plasma 4 | Coating 5 | — | Passed |
| 11 | Plasma 4 | Coating 1 | Coating 2 | Passed |
| 12 | Plasma 4 | Coating 3 | — | Passed |
| 13 | Plasma 4 | Coating 4 | Coating 3 | Passed |
| 14 | Plasma 5 | — | — | Passed |
| 15 | Plasma 5 | Coating 5 | — | Passed |
| 16 | Plasma 5 | Coating 1 | Coating 2 | Passed |
| 17 | Plasma 5 | Coating 3 | — | Passed |
| 18 | Plasma 5 | Coating 4 | Coating 3 | Passed |
| 19 | NiCr | — | — | Passed |
| 20 | NiCr | Coating 5 | — | Passed |
| 21 | NiCr | Coating 1 | Coating 2 | Passed |
| 22 | NiCr | Coating 3 | — | Passed |
| 23 | NiCr | Coating 4 | Coating 3 | Passed |
| 24 | Black Alumina | Coating 1 | Coating 2 | Passed |
| 25 | Black Alumina | Coating 4 | Coating 3 | Passed |
| 26 | Aluminum | — | — | Passed |
| 27 | Zirconium Oxide | Coating 1 | Coating 2 | Passed |
| 28 | Zirconium Oxide | Coating 4 | Coating 3 | Passed |
| 29 | Zirconium Oxide | — | — | Passed |
| 30 | Silicon Oxide | Coating 1 | Coating 2 | Passed |
| 31 | Silicon Oxide | Coating 3 | — | Passed |
| 32 | Silicon Oxide | Coating 4 | Coating 3 | Passed |

Example 33

The base carriers for coating were 7 inch (17.8 cm) diameter mild steel carriers. Carriers with a polymeric layer were prepared by applying multiple APLs consisting of C219A as adhesion promoting layer 1 (APL1) and C213A as adhesion promoting layer 2 (APL2), followed by Urethanel as the polymeric layer to the base carrier. The three coating solutions were applied in sequence with a paint brush to the base carrier. Before applying a subsequent coating, the previous coating was allowed to dry for 10 min. at room temperature. Urethanel was thoroughly mixed for 30 min. prior to application. The sequence of coatings was applied to both major surfaces of the carrier. Following drying of the Urethanel coating, the coatings were cured for 30 min. in an oven set at 90° C. The resulting composite coating was lapped with a combination of a 26 μm alumina abrasive sheet and a 5 μm alumina slurry to remove non-uniformities introduced by the painting process. The final coated carrier was 704 μm thick with 111 μm coatings on both sides.

Example 34

Carriers with a polymeric layer were prepared by applying C213B as the adhesion promoting layer and E58219 as the polymeric layer to base carriers described in Example 33. C213B was applied by using a compressed air spray gun. Each side of the base carrier was coated with C213B and allowed to dry for 10 minutes at room temperature. Prior to film lamination, the C213B coated carrier was heat treated for 30 minutes at 90° C. E58219 urethane film was warm laminated to the C213B coated carrier. Lamination was carried out at 149° C. with 6800 kg load for 15 minutes. Silicone coated release paper was used to keep the film from sticking to the platens of the mechanical press. Metal shims were used to set the thickness of the final carrier construction and were placed in the center of the workpiece opening in the carrier and around the outer edge of the carrier. The excess film was removed from the carrier by trimming with a razor blade. The final coated carrier was 642 μm thick with 80 μm of urethane film plus adhesion promoter on either side.

Example 35

A film of Urethanel was prepared by pouring the solution onto a silicon release liner and then metering the solution to the appropriate thickness. The coating was allowed to dry and then cured for 30 minutes at 90° C. The film was removed from the release liner.

Examples 37-42

The base carriers for coating were 7 inch (17.8 cm) diameter 400 series stainless steel carriers as shown in FIG. 3. The base carrier contact area was about 165 $cm^2$ (25.6 $in^2$).

Adhesion Promoting Layers

Prior to applying the APL's, the carriers were solvent cleaned according to the cleaning procedures described for the stainless steel coupons of Examples 1-32, except the following changes to the cleaning procedure were made. The two major opposed surfaces of the base carrier were roughened by abrading with a random orbital palm sander using an 80 grit aluminum oxide coated abrasive (3M Company). This process replaced the roughening process using a Scotch-Brite® Deburring wheel (3M Company). For Examples 39-42, the argon plasma cleaning treatment was that of Examples 1-32. Note that the argon plasma cleaning treatment was performed in a different vacuum chamber from that of the sputter coating processes described below for these examples. The plasma cleaning treatment for Examples 37 and 38 was as follows. First, the carriers were treated in an argon plasma at a gas flow rate of 200 sccm, 20 mTorr pressure and power of 2000 watts for 2 minutes to physically clean the substrate using argon ion bombardment. Immediately following the argon plasma treatment step, the samples were further treated in an oxygen plasma at a gas flow rate of 500 sccm, pressure of 55 mTorr and power of 1000 watts for 30 seconds.

For Examples 37-42, the formation of the APL's and their corresponding sequence of application are described in Table II. The APL's were formed on both major surfaces of the base carrier. Coating 1 and Coating 2 used the same materials and processes of application as described for the preparation of Examples 1-32. The plasma process and sputter coating processes are described below.

Plasma 6 was a two step process as follows. Step 1: a diamond-like glass thin film was deposited by mixing tetramethylsilane vapor and oxygen gas at flow rates of 150 sccm and 500 sccm, respectively, at a pressure of 70 mTorr and power of 1000 watts for 15 seconds. Step 2: methyl groups left behind by step 1 above were removed by exposure to an oxygen plasma at a flow rate of 500 sccm, pressure of 55 mTorr and a power of 300 watts for 60 seconds, leaving behind silanol groups on the substrate surface.

An aluminum APL was formed on the surface of carriers using a sputter deposition process similar to that employed for the deposition of Black Alumina coatings except no reactive gas oxygen was admitted into the chamber. The sputter duration time and power level was adjusted to obtain aluminum coatings of varying thickness. A 2 kW, 60 second process yielded an aluminum coating thickness of 1,000 Å, a 1 kW, 60 second process yielded an aluminum coating of thickness of 500 Å and a 1 kW, 30 second process yielded an aluminum coating thickness of 265 Å.

The AlTiN APL was formed on the carrier surface by a standard commercial sputter process, a cathodic arc process with aluminum/titanium target in the presence of nitrogen gas.

Polymeric Layer

The same materials and same processes used to fabricate the polymeric layers of Examples 1-32 were used to fabricate the polymeric layers of Examples 37-42.

TABLE II

APL's and Sequence

| Example | APL1 | APL2 | APL3 | APL4 | Test Result |
|---|---|---|---|---|---|
| 37 | Plasma 6 | Coating 6 | Coating 1 | Coating2 | Failed |
| 38 | Plasma 6 | Coating 7 | Coating 1 | Coating2 | Failed |
| 39 | Aluminum 1000 Å Thick | Coating 1 | Coating 2 | — | Passed |
| 40 | Aluminum 500 Å Thick | Coating 1 | Coating 2 | — | Passed |
| 41 | Aluminum 265 Å Thick | Coating 1 | Coating 2 | — | Passed |
| 42 | AlTiN | Coating 1 | Coating 2 | — | Passed |

Comparative Example A

The carriers of this example were 7 inch (17.8 cm) diameter Lamitex™ glass filled epoxy carriers (PR Hoffman, Carlisle, Pa.).

Comparative Example B

The carriers of this example were 7 inch (17.8 cm) diameter mild steel carriers (uncoated).

Comparative Example C

The film of this example was PE1.

Testing of Examples 1 to 32

Using Test Method 1, Examples 1 to 32 were tested for adhesion of the polymeric layer to the stainless steel coupon. Results are shown in Table 1. All of the Examples passed the adhesion test.

Testing of Comparative Example A

Using Test Method 2, the glass filled epoxy carriers were used to polish both saw cut silicon wafers and previously polished wafers. The removal rate was not affected by the direction of carrier rotation and the process exhibited similar removal rates (6.26 to 6.34 μm/min. for saw cut wafers and 1.28 to 2.81 μm/min. for previously polished wafers) on the top and bottom surfaces. Surface roughness was also similar at top (Rq=37.6 nm) and bottom (Rq=40.1 nm). The low removal rates are indicative of an abrasive that has been dulled.

Testing of Comparative Example B

Using Test Method 2, the uncoated mild steel carriers were used to polish both saw cut silicon wafers and previously polished wafers. Removal rates were higher when the carrier rotation was in the same direction as the last conditioning run. The process was not symmetric, with the top pad cutting much more than the bottom pad. The surface roughness of the wafers was also not symmetrical (top Rq=31.3 nm and bottom Rq=23.8 nm). Test results for Comparative Example B are shown below in Table III.

TABLE III

CE-B Results

| Polish Cycle | Wafer Type | Carrier Rotation | Si Removal Rate (μm/min.) | Top Roughness (Rq, nm) | Bottom Roughness (Rq, nm) |
|---|---|---|---|---|---|
| 1 | Saw Cut | CW | 6.5 | — | — |
| 2 | Polished | CCW | 2 | — | — |
| 3 | Polished | CW | 1.2 | — | — |
| 4 | Saw Cut | CCW | 2.81 | — | — |
| 5 | Polished | CW | 1.32 | — | — |
| 6 | Polished | CCW | 1.16 | — | — |
| 7 | Saw Cut | CW | 6.57 | — | — |
| 8 | Polished | CCW | 2.28 | — | — |
| 9 | Polished | CW | 1.08 | — | — |
| 10 | Saw Cut | CCW | 3.22 | — | — |
| 11 | Polished | CW | 1.3 | — | — |
| 12 | Polished | CCW | 1.07 | — | — |
| 13 | Saw Cut | CW | 5.53 | — | — |
| 14 | Polished | CCW | 2.42 | — | — |
| 15 | Polished | CW | 1.04 | 31.3 | 23.8 |

Testing of Example 33

Using Test Method 2 and the indicated modifications (below), polishing was carried out using the carriers described in Example 33. Saw cut silicon wafers were employed. Initially, three, 10 minute polishing cycles were conducted. Removal rates were high, such that the thickness of the wafer was becoming similar to the thickness of the carrier. The test method was modified to a 5 minute polishing cycle time. Removal rate observed during the first six, five minute cycles averaged 15.7 μm/min. for 18 wafers. The test was interrupted and restarted the next morning without conditioning or break-in. The removal rate observed during the second set of six, five minute cycles averaged 19.2 μm/min. for 18 wafers. Removal rates significantly higher than Comparative Examples A and B were observed. The carriers were checked for wear at 30 minute intervals and were found to have undergone 0.09 μm/min. wear over 90 minutes of testing, including the first three 10 minute polishing cycles. The surface roughness was similar between the top surface and bottom surface of the wafer, indicating symmetrical polishing behavior between the top and bottom wafer surfaces.

Testing of Example 34

Using Test Method 2 and the indicated modifications (below), polishing was carried out using the carriers described in Example 34. Polishing was carried out using saw cut silicon wafers. The polishing cycle time was 5 minutes, with the total polishing time being 120 min., i.e., a total of 24 cycles. After polishing, the removal rates were measured as shown in Table IV. Removal rates significantly higher than Comparative Examples A and B were observed. Excluding the first four polishing cycles, removal rates also showed good stability from cycle to cycle. The coated carrier's removal rates show less sensitivity to the carrier rotational direction. The carrier wear was measured at 30 minute intervals. The wear rate of the carriers over the last 90 minutes was 0.08 μm/min. in areas where the carrier thickness was less than the final silicon wafer thickness. The surface roughness (Rq) of the polished wafers was measured to be 106.1 nm. The surface roughness and removal rate of the wafers polished with the carriers of Example 34 were similar on both the top and bottom. This indicates that the polishing was symetrical between the top and bottom surface of the wafer. An additional improvement was that the removal rate was similar for both CW and CCW rotation of the carrier.

TABLE IV

| Polish Cycle | Sample | Carrier Rotation | Si Removal Rate (μm/min.) |
|---|---|---|---|
| 1 | 1A | CW | 23.9 |
| 2 | 1B | CCW | 25.2 |
| 3 | 1C | CW | 24.0 |
| 4 | 2A | CCW | 26.2 |
| 5 | 2B | CW | 28.4 |
| 6 | 2C | CCW | 27.6 |
| 7 | 3A | CW | 28.6 |
| 8 | 3B | CCW | 28.9 |
| 9 | 3C | CW | 30.7 |
| 10 | 4A | CCW | 29.2 |
| 11 | 4B | CW | 30.2 |
| 12 | 4C | CCW | 30.4 |
| 13 | 5A | CW | 33.2 |
| 14 | 5B | CCW | 33.8 |
| 15 | 5C | CW | 33.8 |
| 16 | 6A | CCW | 34.1 |
| 17 | 6B | CW | 33.2 |
| 18 | 6C | CCW | 33.4 |
| 19 | 7A | CW | 34.7 |
| 20 | 7B | CCW | 32.6 |
| 21 | 7C | CW | 30.9 |
| 22 | 8A | CCW | 32.7 |
| 23 | 8B | CW | 32.0 |
| 24 | 8C | CCW | 32.7 |

Testing of Example 35, Example 36 and Comparative Example C

Free films of Urethanel, E58219 and PE1 (a polyester film which had shown some utility as a polymeric layer for carriers) identified as Example 35, Example 36 and Comparative Example C, respectfully, were tested according to Test Method 3. Results are shown in Table V. Generally, the useful life of a carrier comprising a polyurethane film surface was significantly improved over a carrier having a polyester film surface. A high energy to break stress correlates well with the carrier life improvement.

Testing of Examples 37 to 42

The carriers were tested for the adhesion of the polymeric layer using Test Method 4. Results are shown in Table II. Examples 39-42 all passed this aggressive test. Examples 37 and 38 did not survive the extreme conditions of Test Method 4, but are suitable under less extreme conditions.

TABLE V

| | Example 35 | Example 36 | Comparative Example C |
|---|---|---|---|
| Energy to Break Stress (Joules) | 30.6 | 21.8 | 5.1 |
| Standard Deviation (Joules) | 5.4 | 1.9 | 0.2 |
| Break Stress (MPa) | 18 | 87 | 245 |
| Standard Deviation (MPa) | 3 | 3 | 4 |
| Strain at Break Stress % | 2451 | 1306 | 119 |
| Standard Deviation % | 123 | 261 | 5 |
| Thickness (mm) | 0.191 | 0.058 | 0.038 |

It should be understood that the invention is not necessarily limited to the specific process, arrangement, materials and components shown and described above, but may be susceptible to numerous variations within the scope of the invention. For example, although the above-described exemplary aspects of the invention are believed to be particularly well suited for polishing silicon wafers, the concepts of the present invention can be applied in other applications. For example, the concepts of the present application can be used whenever it is desired to provide a polishing machine with planar, parallel surfaces during a polishing operation. It also should be understood that the above description of the preferred embodiments of the present invention are susceptible to various modifications, changes and adaptations, and the same are intended to be comprehended within the meaning and range of equivalents of the appended claims.

The invention claimed is:

1. A lapping carrier comprising a base carrier having a first major surface, a second major surface and at least one aperture for holding a workpiece, said aperture extending from the first major surface through the base carrier to the second major surface, wherein:

a) the base carrier comprises a first metal or a polymer, b) at least a portion of the first major surface or at least a portion of each of the first and the second major surfaces comprises a polymeric region and, c) in at least a portion of the polymeric region, at least one adhesion promoting layer is interposed between the polymeric region and the base carrier said adhesion promoting layer comprises an inorganic coating;

wherein the inorganic coating comprises a second metal, a metal oxide, or a combination thereof.

2. The lapping carrier of claim 1, wherein the first metal comprises steel or stainless steel and the polymer comprises a thermoset polymer, a thermoplastic polymer or combinations thereof and optionally wherein the second metal comprises aluminum or aluminum titanium nitride and the metal oxide comprises silica, zirconia, alumina or combinations thereof.

3. The lapping carrier of claim 1, wherein the polymeric region comprises a thermoset polymer, a thermoplastic polymer, a thermoset polyurethane, a thermoplastic polyurethane, or a combination thereof.

4. The lapping carrier of claim 1, wherein the adhesion promoting layer comprises a multi-layer adhesion promoting layer comprising at least a first adhesion promoting layer and a second adhesion promoting layer wherein the adhesion promoting layers are chemically distinct.

5. A method of lapping comprising:

a. providing a double-sided lapping machine having two opposed lapping surfaces or a single-sided lapping machine;

b. providing a carrier comprising a base carrier having a first major surface, a second major surface and at least one aperture for holding a workpiece, the aperture extending from the first major surface through the base carrier to the second major surface, wherein:

i) the base carrier comprises a first metal or a polymer;

ii) at least a portion of the first major surface or at least a portion of each of the first and the second major surfaces comprises a polymeric region; and iii) in at least a portion of the polymeric region, at least one adhesion promoting layer is interposed between the polymeric region and the base carrier, the adhesion promoting layer comprising an inorganic coating wherein the inorganic coating comprises a second metal, a metal oxide, or a combination thereof;

c. providing a workpiece;

d. inserting the workpiece into the aperture;

e. inserting the carrier into the lapping machine;

f. providing relative motion between the workpiece and the lapping surface while maintaining contact between the lapping surface and the workpiece; and g. removing at least a portion of the workpiece.

6. The method of claim 5, wherein the lapping machine is a double-sided lapping machine having two opposed lapping surfaces and further comprising providing relative motion between the workpiece and the two opposed lapping surfaces while maintaining contact between the lapping surfaces and the workpiece.

7. The method of claim 5, further comprising providing a working fluid at the interface between the workpiece and the lapping surfaces, optionally wherein the working fluid comprises abrasive particles.

8. The method of claim 6, wherein at least one of the two opposed lapping surfaces comprises a three-dimensional, textured, fixed-abrasive article.

9. The method of claim 8, wherein the three-dimensional, textured, fixed-abrasive article comprises diamond particles and/or agglomerates disposed in a binder.

10. The method of claim 8, wherein at least one of the two opposed lapping surfaces comprises pellet laps.

11. The method of claim 5, wherein the lapping machine is a single-sided lapping machine and further wherein the carrier comprises a polymeric region on the surface of the base carrier which contacts the abrasive surface of the lapping machine.

* * * * *